US005873303A

United States Patent [19]

Hodosy et al.

[11] Patent Number: 5,873,303

[45] Date of Patent: Feb. 23, 1999

[54] METHOD FOR BINDING BUNDLED OBJECTS, IN PARTICULAR PIECES OF CABLE, AS WELL AS AN ASSOCIATED APPARATUS AND A BINDING MATERIAL

[75] Inventors: Hans Hodosy; Beat Hodosy, both of Wallisellen, Switzerland

[73] Assignee: Fapro Automation AG, Wallisellen, Switzerland

[21] Appl. No.: 860,494

[22] PCT Filed: Oct. 21, 1996

[86] PCT No.: PCT/CH96/00368

§ 371 Date: Jun. 30, 1997

§ 102(e) Date: Jun. 30, 1997

[87] PCT Pub. No.: WO97/17260

PCT Pub. Date: May 15, 1997

[30] Foreign Application Priority Data

Nov. 3, 1995 [CH] Switzerland ..... 03120/95

[51] Int. Cl.[6] ..... B65B 27/10; B65B 13/24; B65D 63/10

[52] U.S. Cl. ..... 100/2; 24/16 PB; 100/8; 100/26; 100/29; 100/33 PB; 140/93.2

[58] Field of Search ..... 100/2, 8, 16, 25, 100/26, 29, 32, 33 R, 33 PB; 24/17 AP, 30.5 P, 16 PB; 140/93 A, 93.2, 123.6

[56] References Cited

U.S. PATENT DOCUMENTS

| | | | |
|---|---|---|---|
| 2,420,498 | 5/1947 | Pojman | 100/8 |
| 2,961,785 | 11/1960 | Toepfer | 24/16 PB |
| 3,072,986 | 1/1963 | Lefnaer | 24/16 PB |
| 3,250,209 | 5/1966 | Gage et al. | 100/26 |
| 3,731,347 | 5/1973 | Caveney et al. | 24/16 PB |
| 4,696,327 | 9/1987 | Wolcott . | |
| 5,465,659 | 11/1995 | Minen | 100/26 |

FOREIGN PATENT DOCUMENTS

| | | |
|---|---|---|
| 0521199 | 1/1993 | European Pat. Off. . |
| 1168600 | 12/1958 | France . |

*Primary Examiner*—Stephen F. Gerrity
*Attorney, Agent, or Firm*—Wenderoth, Lind & Ponack, L.L.P.

[57] ABSTRACT

A method for binding bundled objects, in particular pieces of cable is disclosed. A first end of a binding material is used to encircle the bundled objects and is then passed through an opening located on a second end of the binding material. A pulling force is then applied to the binding material thereby tightly securing the bundled objects. The binding material is then bent forming a folded edge and passed through a second opening. Finally, the first end is pressed against a portion of the binding material wrapped around the bundled objects, thus producing a static friction and securing the bundled objects.

18 Claims, 4 Drawing Sheets

METHOD FOR BINDING BUNDLED OBJECTS, IN PARTICULAR PIECES OF CABLE, AS WELL AS AN ASSOCIATED APPARATUS AND A BINDING MATERIAL

BACKGROUND OF THE INVENTION

The invention relates to a method for binding bundled objects, in particular pieces of cable, in which a bundle is tightly bound together by at least one binding material. The invention further relates to an associated apparatus as well as a binding material.

In the processing of electrical cables, in certain applications the latter are cut from a roll of cable in pieces having a length of for example between 20 and 200 mm. Both ends of the insulation sheath are removed (stripped) and subsequently the pieces of cable are combined in bundles by hand and packed. Before using these pieces of cable, the bundles are again opened by hand and the pieces of cable are used for electrical connections, for example in circuits or the like.

Binding materials are known, which are made from synthetic material and at one end comprise an eye, into which is inserted the binding material. The binding material is constructed as a cord and has a perforation provided on the periphery over its length. The perforation ensures that when the binding material is tightened around a bundle, it is attached in the eye in the manner of a barb. However, this binding material can only be detached from the bundle with some difficulty and it is not suitable for producing bundles by machine.

SUMMARY OF THE INVENTION

In comparison therewith, it is the object of the present invention to provide a method and a binding material for binding bundled objects, in particular pieces of cable, by which a bundle of elongated objects can be bound together by machine in a simple manner. The invention allows the binding material holding this bundle together to be produced economically, and guarantees that the bundle is held together durably while also being releasable by hand. Furthermore, the binding material bears against the outer periphery of the bundle and has no projecting ends.

This object is achieved by a binding material comprising an opening at one end and another end which is guided through this opening. The end without the opening is first wound around the bundle. Then, tension is applied to the binding material holding the bundle together. Next the end is bent back at the point of the opening, thus forming a folded edge. Finally, in order to produce static friction at this folding edge, the remaining end of the binding material is pressed against the binding material laid around the bundle.

With this method according to the invention, a bundle may be bound very simply and with great operational reliability in an automated manner. In addition, the binding material used in this method can be produced cheaply and after the binding has been completed, it can be released easily by hand.

BRIEF DESCRIPTION OF THE DRAWINGS

Embodiments of the invention as well as further advantages thereof are described in detail hereafter with reference to the drawings, in which.

DETAILED DESCRIPTION OF THE INVENTION

Figure 1:
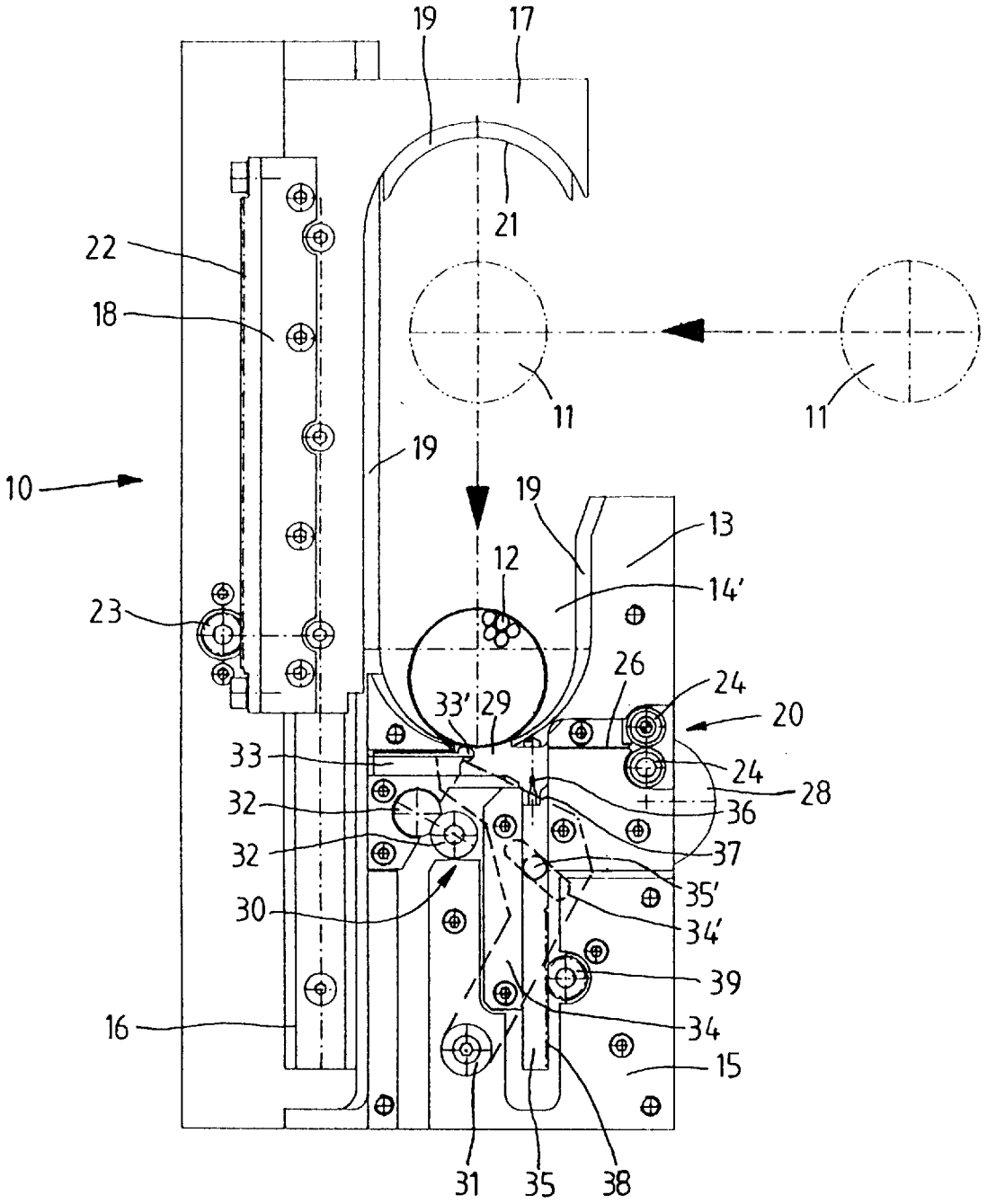
FIG. 1 is a side view of an apparatus according to the invention for binding a bundle.

FIG. 1 shows an apparatus 10 for binding a bundle 11, which is formed from a plurality of pieces of electrical cable 12 laid one beside the other. In this case, the bundle 11 forms a virtually cylindrical shape and is inserted in an opening 14' of the apparatus 10 by a handling arrangement. In principle, objects other than the pieces of electrical cable provided could be bundled, for example synthetic material parts, wires or the like.

The apparatus 10 consists essentially of a stand 15, a guide rail 16 arranged vertically laterally on the stand, a carriage 18 held so that it is able to move vertically on the guide rail, a bracket 17 provided in the carriage, a feed device 20 for supplying the binding material and a processing device 30. The stand 15 comprises a receiving head 13 for a respective bundle 11, which is provided with a semi-circular opening 14' open on an upper side and having a guide groove 19 surrounding the opening. This guide groove 19 extends as far as the bracket 17 and is continued in the bracket in a semi-circular recess 21 open on an under side. The carriage 18 comprises a rack 22 on its side, which meshes with a pinion 23, which is able to rotate by a drive, for example a stepping motor. The carriage is thus arranged to be vertically adjustable.

The feed device 20 for the binding material comprises two rotary rollers 24 arranged with the axes parallel to each other, between which the binding material is guided. Upon rotation of the rollers, at least one of which is driven by an indicated rotary drive 28, the binding material is introduced through a guide slot 26 and through a through-hole 29 aligned tangentially to opening 14'. At this point, the binding material is guided in the guide groove 19.

The processing device 30, for binding the binding material, comprises a pulling device, which consists of two rollers 32 constructed as gear wheels. The two rollers are driven by a rotary drive (not shown in detail) and are intended for exerting a predetermined tension on the binding material arriving between the two rollers. Also associated with this processing device 30 is a carriage 33 able to move longitudinally approximately tangentially with respect to the opening 14. The carriage has a guide head 33' as well as a cutter 35 able to move up and down approximately at right angles to the guide slot 26. The cutter 35 is driven by a rack 38 meshed with a gear wheel 39. The gear wheel is driven by way of a rotary motor, which is not shown. The carriage 33 is guided to move by a toggle joint 34 shown in broken line, which is tiltably mounted on the stand 15 at its lower end by way of a rotary mounting 31. The toggle joint comprises a guide slot 34', in which a cam 35' located on the cutter 35 engages. The toggle joint 34 is tilted at the time of displacement of the cutter and accordingly the carriage 33 is moved longitudinally. The toggle joint 34 is designed so that the cutter 35 and the carriage 33 are either moved towards each other or away from each other.

Figure 2:
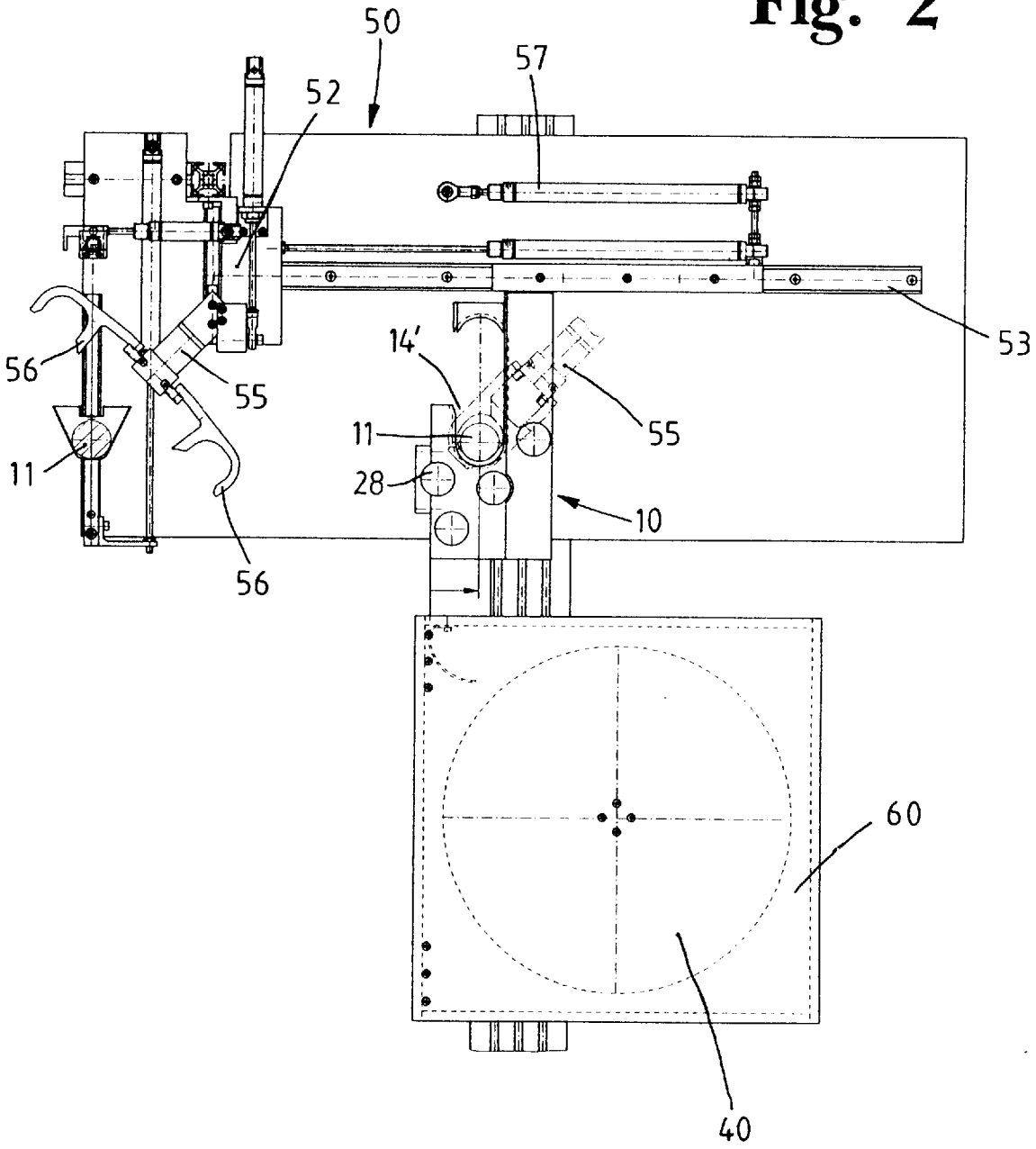
FIG. 2 is a view of a supply station with the apparatus according to FIG. 1.

FIG. 2 is a diagrammatic illustration of a supply station 50 for transporting the bundle 11 to the apparatus 10. FIG. 2 also shows a cassette 60, in which the binding material is rolled up. After being cut off mechanically and having both ends stripped, pieces of cable or the like are normally stacked as a bundle 11 in a tub 51 (shown solely in outline). As soon as a certain number of pieces of cable of this type has formed a bundle, robot-like gripper tongs 55 grasp the bundle 11 formed in the tub 51. For this purpose, a transverse slot (not shown in detail) is provided in the tub 51. The two grippers 56 grasp and remove the bundle from the slot, introduce the bundle into the opening 14' of the apparatus 10, and advantageously hold the bundle securely during binding. The gripper tongs 55 are tiltably held on a carriage 52, which is in turn guided to slide longitudinally along a guide path 53 by way of a drive 57. By means of a combination movement of the tongs 55, taking place in a conventional manner, the bundle 11 may be introduced into the opening 14' or removed therefrom. The apparatus 10 is illustrated from the rear side with the various above-mentioned stepping motors.

Figure 3:
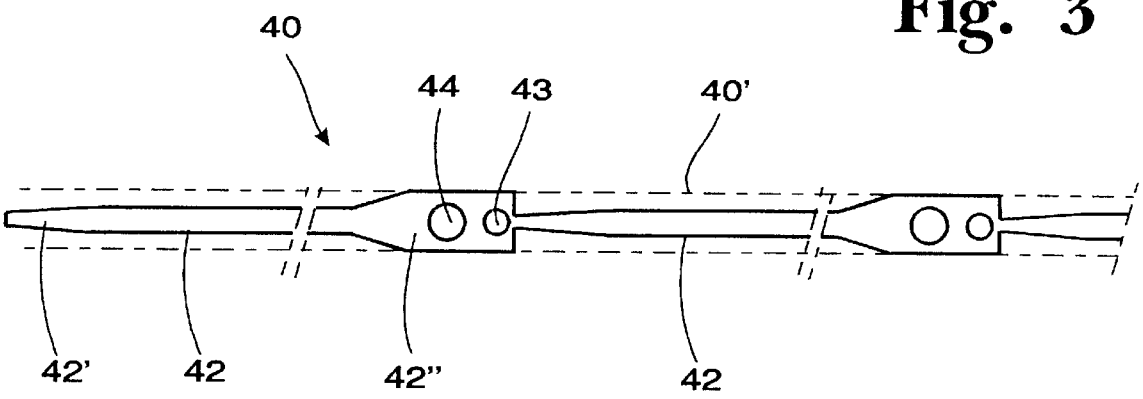
FIG. 3 shows a binding material constructed as an endless sheet strip for the apparatus according to FIG. 1.

As shown in FIG. 3, an endless sheet strip is provided for the binding material 40. The endless sheet strip comprises strip pieces 42, which are used to bind bundle 11 and are formed one after the other in the endless sheet strip. Each strip 42 has a tongue-like narrow portion at one end 42' and at the other end 42" widens out somewhat. An opening 44 for receiving the end 42' as well as another hole 43 are located on the outer end 42". The sheet strip is preferably made from polyester; however, in principle, it may also be made from another synthetic material or a metal foil. Moreover, the strip material 40 is stamped from a full strip 40' shown in broken line.

According to the invention, the binding material 40 comprising an opening 44 at one end 42" is introduced by its other end 42', after winding around the bundle 11, through this opening 44. A pulling force holding the bundle 11 together is produced on the binding material and it is bent back at the point of the opening 44 thus forming a folded edge. A tip or remaining end 47 of the binding material is pressed in a releasable connection against the binding material wound around the bundle, in order to produce static friction at this folded edge.

Figure 4:
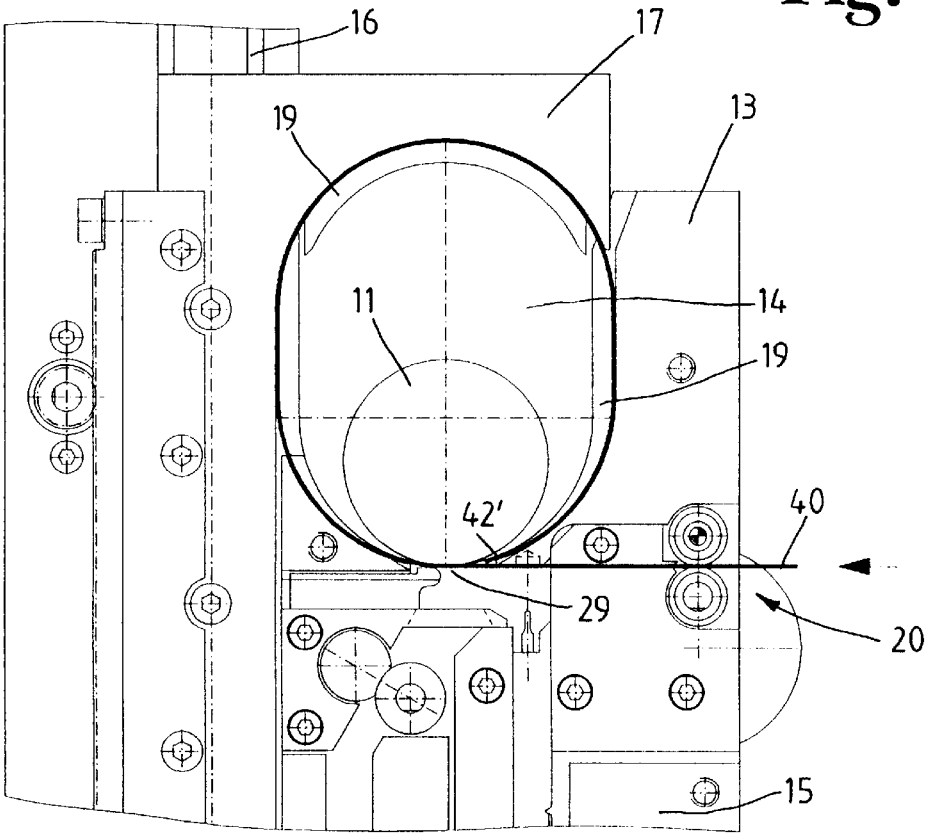
FIG. 4 shows the apparatus according to FIG. 1 at the time of insertion of the binding material.
Figure 5:
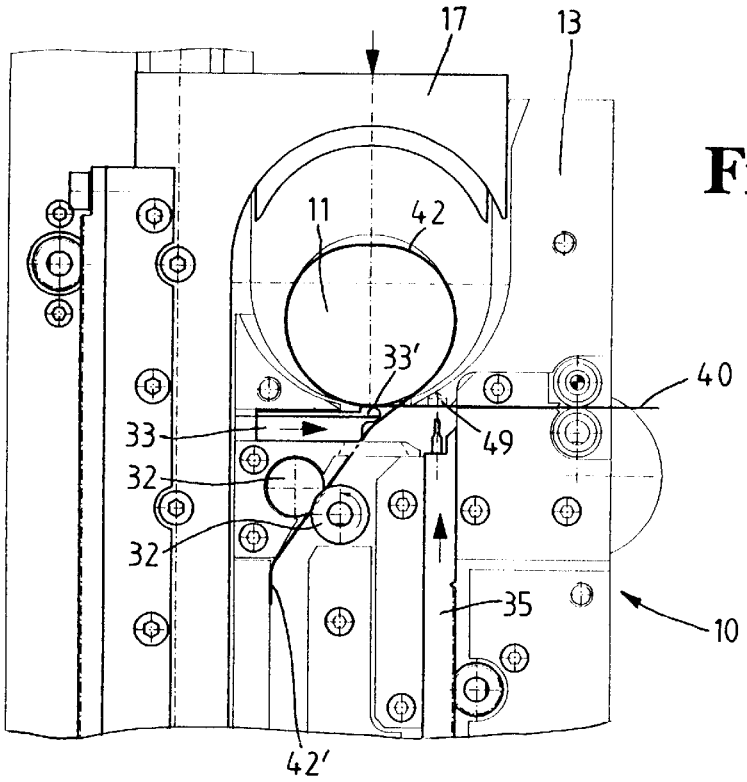
FIG. 5 shows the apparatus at the time of binding a bundle tightly.
Figure 6:
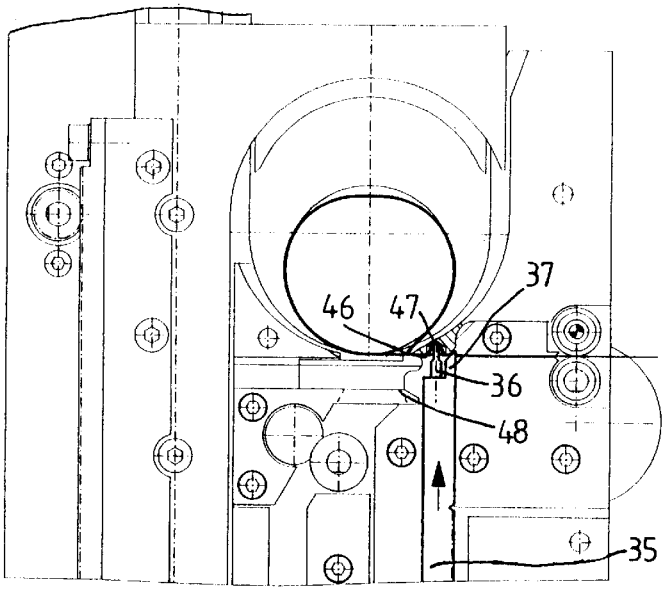
FIG. 6 shows the apparatus at the time of folding and cutting-off of the binding material and FIG. 7 is a partial view of the bundle with the binding material bound around the bundle.

The individual steps of the method for binding a bundle 11 are thus described hereafter with reference to FIG. 4 to 6.

According to FIG. 4, bracket 17 is located with respect to the stand 15 so that after the downwards movement of the carriage 18, bracket 17 is moved into a first predetermined position. Thus, from the semi-circular opening 14', an opening 14 completely closed is made and the guide groove 19 consequently extends completely around this opening. In this position of the bracket 17, the binding material 40 is guided by the tongue-like front end 42' by means of the feed device 20 from the cassette 60 through the through-hole 29 into the guide groove 19 and back again to the lower end of the opening 14. As soon as the opening 44 in the rear end 42" of the piece of strip 42 comes into alignment with the through-hole 29 in the receiving head 13, the feed of the strip is stopped. This strip 42 of the binding material is measured in length so that its front end 42' has virtually reached opening 44 after stopping the strip. Thus bundles 11 having different diameters may be inserted without the apparatus 10 having to be specially set up for the respective diameter and without strips of different lengths being required. In the example illustrated, the outer diameter of the bundle is approximately half as large as that of the opening.

According to FIGS. 5 and 6, after the strip 42 has been stopped, the bracket 17 is moved further downwards into the illustrated second predetermined position. This has the effect that the front end 42' of the strip 42 is pushed through the opening 44 and further between the two rollers 32 constructed as gear wheels. The two rollers advantageously rotate in the direction of the arrow and engage the strip and pull it until it binds the bundle 11 with a predetermined tension, as shown. This is achieved by means of a slipping clutch (not shown in detail), which with an adjustable loading movement disengages and releases the rollers from the drive. After the stoppage of the rollers 32, the cutter 35 and the carriage 33 connected thereto by way of the toggle joint 34 move towards the strip 42. First, the guide head 33' of the carriage 33 sliding directly below the end of the strip 42" bends down the front end of the strip 42', until it forms a folded edge 46 in the opening 44. Then the strip end 42' is cut by the carriage 33 at the cutting edge 48. The remaining end 47 is pushed into a further hole 43 of the other end of the strip 42" by the pin 36 thereby moving into the hole 43, due to which this end 47 is permanently held therein. For this purpose, a recess 49 is provided in the receiving head 13, into which the pin 36 can be inserted. At the same time, the cutting edge 37 projecting from the cutter head beside the pin 36, cuts the end 42" from the following strip. The bundle 11 is thus bound and after retraction of the carriage 33 and the cutter 35 and the upwards sliding of the bracket 17, it can be removed from the apparatus 10 by means of the above-mentioned gripper tongs 55 and stored in a container or the like.

Figure 7:
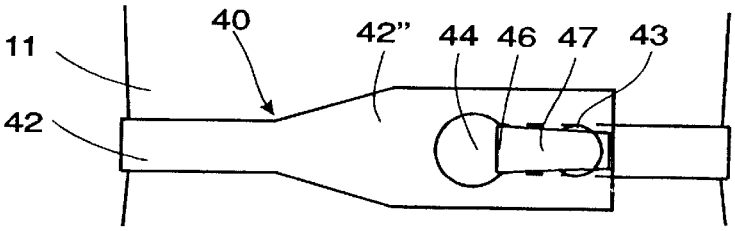

FIG. 7 once again shows the partially illustrated bundle 11 in the bundled state. The remaining end 47 of the strip 42 engages in the hole 43 provided behind the opening 44. The end 47 is consequently pressed against the bundle, whereby the static friction between contacting points of the strip 42', 42" guarantee engagement at the folding edge 46.

In the illustrated views of the apparatus 10, with the exception of FIG. 2, the front covering walls have been omitted from the stand 15, the receiving head 13 as well as from the bracket 17, so that this apparatus is respectively illustrated as in a longitudinal section.

The control of the said stepping motors and drives preferably takes place by means of a control device not described in detail, which operates in a known manner and controls the sequence of operations according to the invention appropriately.

Naturally, the strip material as well as the apparatus could also be shown in another variation. However, the present invention is satisfactorily shown. The opening 44 as well as the hole 43 in the end of the strip 42" could for example be constructed as a slot or in some other way.

We claim:

1. A method for binding bundled objects comprising:

inserting the bundled objects into a space formed in a binding apparatus;

enclosing the bundled objects within the space;

feeding a binding material from a feed device through a through-hole formed substantially tangent to the space;

encircling the bundled objects with the binding material;

guiding a first end of the binding material through an opening formed in a second end of the binding material;

pulling the first end of the binding material to secure the bundled objects into a bundle;

bending the first end of the binding material at the opening to form a folded edge; and pressing the first end against the binding material encircling the bundle thereby producing a static friction and binding the bundled objects.

2. The method of claim 1 further comprising:

moving a bracket towards a receiving head of the binding apparatus to enclose the bundled objects within the space.

3. The method of claim 1, further comprising:

stopping feed of the binding material when the opening of the binding material is aligned with the through-hole;

guiding the first end through the through-hole into a processing device;

pulling the first end of the binding material by utilizing the processing device thereby tightly surrounding the bundled objects within the binding material.

4. The method of claim 3, further comprising:

pushing the binding material through the opening and the through-hole into the processing device by moving a bracket toward a receiving head of the binding apparatus to a predetermined position.

5. The method of claim 4, further comprising:

bending the first end by moving a carriage connected to processing device toward the second end of the binding material in a direction substantially tangent to the bundled objects;

cutting the binding material at a certain position thereby defining a free end.

6. The method of claim 5, further comprising:

inserting the free end into a second opening located on the binding material behind the opening;

cutting the binding material to define a second free end by moving a cutter located on the processing device toward the second end in a direction substantially perpendicular to the binding material, thereby binding the bundle of objects and allowing removal from the binding apparatus.

7. An apparatus for binding bundled objects, comprising:

a stand;

a receiving head provided on said stand;

a bracket provided on said stand opposite said receiving head thereby forming a space to receive the bundled objects;

a feed device operably connected to said stand to feed a binding material into said space such that the binding material encircles the bundled objects; and a processing device operably connected to said stand to exert a pulling force on the binding material and to form a folded edge on the binding material.

8. The apparatus of claim 7, wherein:

a guide groove is formed on said stand, said receiving head, and said bracket, thereby encircling said space, to guide the binding material around the bundled objects.

9. The apparatus of claim 7, wherein:

a through-hole is formed substantially tangent to said space to allow the binding material to be fed therethrough and into said space to encircle the bundled objects.

10. The apparatus of claim 7, wherein:

said bracket is vertically movable with respect to said receiving head to open and close said space.

11. The apparatus of claim 7, wherein said processing device comprises:

a carriage movable in a direction substantially tangent to said space, to form the folded edge;

a cutter vertically movable in a direction perpendicular to a direction of supply of the binding material; and a pulling device to exert a pulling force on the binding material.

12. A strip comprising:

a first end having a smooth tongue-like construction, free of serrations;

a second end, opposite said first end, having at least one opening;

wherein said at least one opening is shaped such that said first end may be inserted and removed without catching in said at least one opening.

13. The strip of claim 12, wherein:

said strip is constructed as an endless sheet strip with each strip arranged attached to another.

14. The strip of claim 12, wherein:

said at least one opening comprises a first hole and a second hole.

15. The strip of claim 14, wherein:

said first hole is larger than said second hole.

16. The strip of claim 12, wherein:

said at least one opening is circular.

17. The strip of claim 12, wherein:

said strip is comprised of a synthetic material.

18. The strip of claim 12, wherein:

said strip is comprised of polyester.

* * * * *